US012590450B2

(12) United States Patent
Oh

(10) Patent No.: US 12,590,450 B2
(45) Date of Patent: Mar. 31, 2026

(54) URINAL SYSTEM

(71) Applicant: Jay K Oh, Wycoff, NJ (US)

(72) Inventor: Jay K Oh, Wycoff, NJ (US)

( * ) Notice: Subject to any disclaimer, the term of this patent is extended or adjusted under 35 U.S.C. 154(b) by 149 days.

(21) Appl. No.: 18/782,111

(22) Filed: Jul. 24, 2024

(65) Prior Publication Data

US 2026/0028812 A1 Jan. 29, 2026

(51) Int. Cl.
*E03D 13/00* (2006.01)

(52) U.S. Cl.
CPC ..... *E03D 13/005* (2013.01)

(58) Field of Classification Search
CPC ..... E03D 13/00; E03D 13/005; E03D 13/007; E03D 9/00; A61B 5/00; A61B 5/0004; A61B 5/0022; A61B 5/208; A61B 5/743; G01N 1/20; G01N 33/521; G01N 33/523
USPC ..... 4/300.3, 301, 309, 314, 222.1, 144.1, 4/256.1, 661
See application file for complete search history.

(56) References Cited

U.S. PATENT DOCUMENTS

| | | | | |
|---|---|---|---|---|
| 9,895,095 | B2 | 2/2018 | Chen | |
| 10,729,411 | B2 | 8/2020 | Wang | |
| 11,255,081 | B2 * | 2/2022 | Oh | G01N 33/521 |
| 11,654,042 | B2 | 5/2023 | Hughett, Sr. | |
| 11,911,160 | B2 | 2/2024 | Woodard et al. | |
| 2018/0003621 | A1 * | 1/2018 | Drury | E03D 13/005 |
| 2018/0163388 | A1 * | 6/2018 | Staton | E03D 13/00 |
| 2023/0096779 | A1 * | 3/2023 | Coon | E03D 13/005 73/61.55 |

FOREIGN PATENT DOCUMENTS

| | | | | |
|---|---|---|---|---|
| CN | 107178134 A | * | 9/2017 | E03D 13/00 |

* cited by examiner

*Primary Examiner* — Tuan N Nguyen
(74) *Attorney, Agent, or Firm* — JIKIM LAW

(57) ABSTRACT

The present invention is a urinal system that includes a urinal bowl, a drain, a urinal screen, a spreading layer, an image capturing unit, an optical sensing unit, a urine analysis unit, and a display unit. The spreading layer attached to the urinal screen contains a reagent that can react with glucose in a urine sample to cause a color change in the reagent. The image capturing unit is configured to capture an image of the color change in the reagent when the optical sensing unit detects the color change in the reagent. The urine analysis unit is configured to perform operations to analyze the image of the color change in the reagent and generate a test result based on the operations about the components of the urine sample. The display unit is configured to display the test result for presentation to a user.

20 Claims, 5 Drawing Sheets

URINAL SYSTEM

TECHNICAL FIELD & BACKGROUND

The present invention generally related to a urinal system, and in particular, to an improved urinal system.

People often check urine for signs of disease and for clues about overall health. The most common test for urine is the dipstick test that uses a special strip of paper that is dipped in to a sample of urine.

Each dipstick test requires the following steps: (1) collect a fresh urine sample in a clean, dry cup, (2) take one urine test strip, (3) dip the test areas of the strip in the urine, and (4) observe the change in color of the test strip.

As described above, the conventional steps involved in the dipstick test requires at least 4 or 5 steps. These burdensome steps obviously inconvenience people.

Therefore, it would be desirable to provide an improved urinal system that could allow a user to check urine for signs of disease without such burdensome steps involved in the dipstick test.

SUMMARY OF THE INVENTION

The present invention is directed to a urinal system that overcomes the above-mentioned disadvantages of the prior art.

In one aspect, the present invention provides a urinal system having a urinal bowl, a drain, a urinal screen, a spreading layer, an image capturing unit, an optical sensing unit, a urine analysis unit, and a display unit. The drain is attached to the urinal bowl. The urinal screen is attached to the urinal bowl, the urinal screen is sized and shaped to be placed in the urinal bowl, and the urinal screen is configured to extend over a portion of the drain. The spreading layer is configured to accept a urine sample on a upper side and passing the sample to a lower side, opposite and each side containing a reagent that can react with glucose in the urine sample, as it passes through the spreading layer, to cause a color change in the reagent, and the spreading layer is attached to the urinal screen. The image capturing unit is configured to capture an image of the color change in the reagent, the image capturing unit is attached to the urinal bowl, and the image capturing unit is sized and shaped to be placed in the urinal bowl. The optical sensing unit is configured to detect the color change in the reagent, the optical sensing unit is attached to the urinal bowl, and the optical sensing unit is sized and shaped to be placed in the urinal bowl. The image capturing unit is configured to capture the image of the color change in the reagent when the optical sensing unit detects the color change in the reagent. The urine analysis unit is configured to analyze components of the urine sample. The urine analysis unit is attached to the urinal bowl. The urine analysis unit is configured to receive the image of the color change in the reagent captured by the image capturing unit. The urine analysis unit is configured to perform operations to analyze the image of the color change in the reagent. The urine analysis unit is configured to generate a test result based on the operations about the components of the urine sample. The display unit is configured to display the test result for presentation to a user. The display unit is attached to the urinal bowl. The display unit is configured to receive the test result from the urine analysis unit. The urine analysis unit is communicably connected to the image capturing unit, the optical sensing unit, and the display unit.

In another aspect, the present invention provides a urinal system having a urinal bowl, a drain, a urinal screen, a spreading layer, an image capturing unit, an optical sensing unit, a urine analysis unit, and a display unit. The drain is attached to the urinal bowl. The urinal screen is attached to the urinal bowl, the urinal screen is sized and shaped to be placed in the urinal bowl, and the urinal screen is configured to extend over a portion of the drain. The spreading layer is configured to accept a urine sample on a upper side and passing the sample to a lower side, opposite and the upper side containing a reagent that can react with glucose in the urine sample, as it passes through the spreading layer, to cause a color change in the reagent, and the spreading layer is attached to the urinal screen. The image capturing unit is configured to capture an image of the color change in the reagent, the image capturing unit is attached to the urinal bowl, and the image capturing unit is sized and shaped to be placed in the urinal bowl. The optical sensing unit is configured to detect the color change in the reagent and the optical sensing unit is sized and shaped to be placed in the urinal bowl. The image capturing unit is configured to capture the image of the color change in the reagent when the optical sensing unit detects the color change in the reagent. The urine analysis unit is configured to analyze components of the urine sample. The urine analysis unit is attached to the urinal bowl. The urine analysis unit is configured to receive the image of the color change in the reagent captured by the image capturing unit. The urine analysis unit is configured to perform operations to analyze the image of the color change in the reagent. The urine analysis unit is configured to generate a test result based on the operations about the components of the urine sample. The display unit is configured to display the test result for presentation to a user. The display unit is attached to the urinal bowl. The display unit is configured to receive the test result from the urine analysis unit. The urine analysis unit is communicably connected to the image capturing unit and the display unit.

In a further aspect, the present invention provides a urinal system having a urinal bowl, a drain, a urinal screen, a spreading layer, an image capturing unit, an optical sensing unit, a urine analysis unit, and a display unit. The drain is attached to the urinal bowl. The urinal screen is attached to the urinal bowl, the urinal screen is sized and shaped to be placed in the urinal bowl, and the urinal screen is configured to extend over a portion of the drain. The spreading layer is configured to accept a urine sample on a upper side and passing the sample to a lower side, opposite and the upper side containing a reagent that can react with glucose in the urine sample, as it passes through the spreading layer, to cause a color change in the reagent, and the spreading layer is attached to the urinal screen. The image capturing unit is configured to capture an image of the color change in the reagent, and the image capturing unit is sized and shaped to be placed in the urinal bowl. The optical sensing unit is configured to detect the color change in the reagent and the optical sensing unit is sized and shaped to be placed in the urinal bowl. The image capturing unit is configured to capture the image of the color change in the reagent when the optical sensing unit detects the color change in the reagent. The urine analysis unit is configured to analyze components of the urine sample. The urine analysis unit is attached to the urinal bowl. The urine analysis unit is configured to receive the image of the color change in the reagent captured by the image capturing unit. The urine analysis unit is configured to perform operations to analyze the image of the color change in the reagent. The urine analysis unit is configured to generate a test result based on the operations about the components of the urine sample. The display unit is configured to display the test result for presentation to a user. The display unit is configured to receive the test result from the urine analysis unit. The urine analysis unit is communicably connected to the image capturing unit and the display unit.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments. Various operations will be described as multiple discrete operations, in turn, in a manner that is most helpful in understanding the present invention. However, the order of description should not be construed as to imply that these operations are necessarily order dependent. In particular, these operations need not be performed in the order of presentation. The phrase "in one embodiment" is used repeatedly. The phrase generally does not refer to the same embodiment, however, it may. The terms "comprising", "having" and "including" are synonymous, unless the context dictates otherwise.

This present invention provides a urinal system 100 that could allow a user to check urine for sign of disease without the burdensome steps required by the urine dipstick test.

Figure 1:
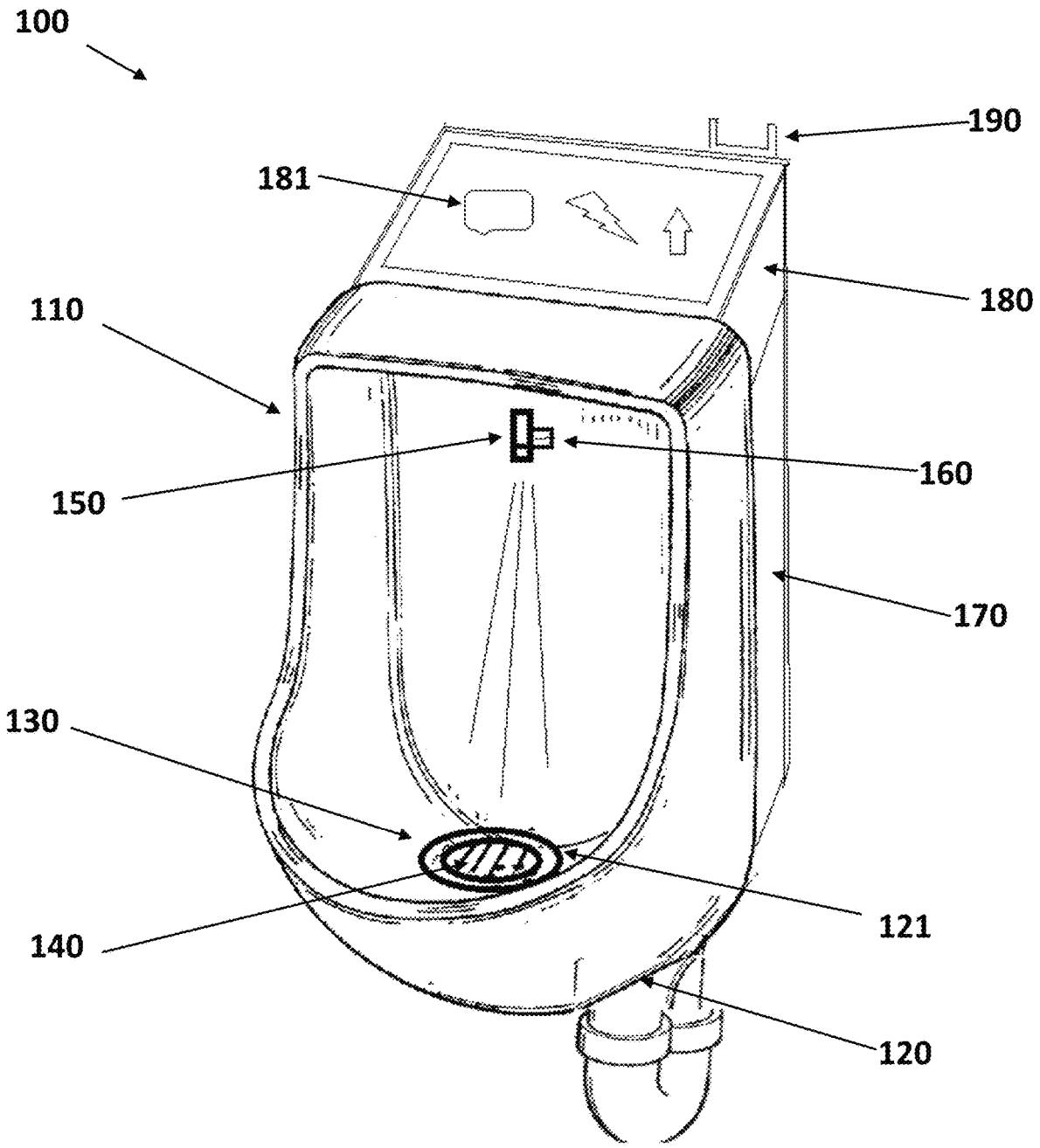
FIG. 1 illustrates a perspective view of a urinal system 100, in accordance with one embodiment of the present invention.

FIG. 1 illustrates a perspective view of a urinal system 100, in accordance with one embodiment of the present invention.

Referring to FIG. 1, a urinal system 100 includes a urinal bowl 110, a drain 120, a urinal screen 130, a spreading layer 140, an image capturing unit 150, an optical sensing unit 160, a urine analysis unit 170, and a display unit 180.

Referring to FIG. 1, the drain 120 is attached to the urinal bowl 110. The urinal screen 130 is attached to the urinal bowl 110, the urinal screen 130 is sized and shaped to be placed in the urinal bowl, and the urinal screen 130 is configured to extend over a portion 121 of the drain 120.

Figure 4:
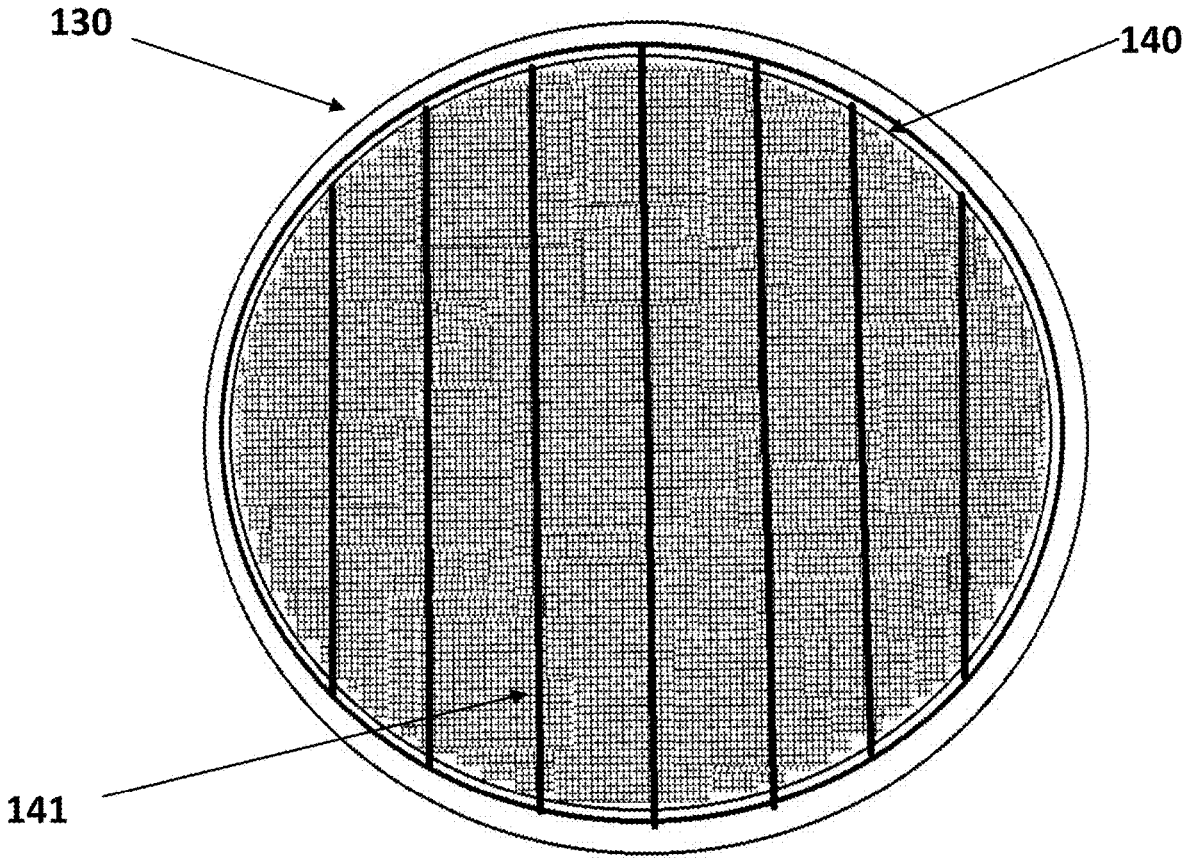
FIG. 4 illustrates a top plan view of a urinal screen and a spreading layer of a urinal system 100, in accordance with one embodiment of the present invention.

FIG. 4 illustrates a top plan view of a urinal screen and a spreading layer of a urinal system 100, in accordance with one embodiment of the present invention.

Figure 5:
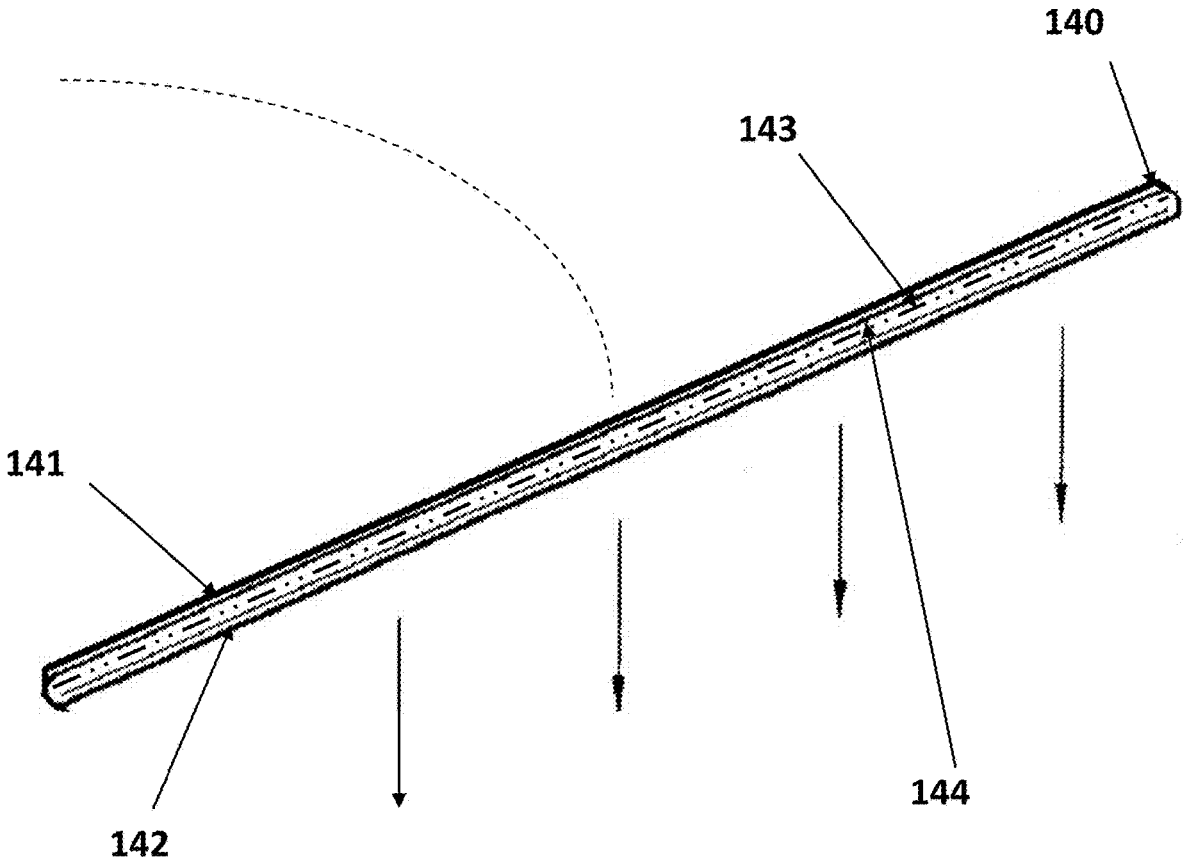
FIG. 5 illustrates a side view of a spreading layer of a urinal system 100, in accordance with one embodiment of the present invention.

FIG. 5 illustrates a side view of a spreading layer of a urinal system 100, in accordance with one embodiment of the present invention.

Referring to FIGS. 1, 4 and 5, the spreading layer 140 is configured to accept a urine sample on a upper side 141 and passing the sample to a lower side 142, opposite and each side containing a reagent 143 that can react with glucose in the urine sample, as it passes through the spreading layer 140, to cause a color change in the reagent 143, and the spreading layer 140 is attached to the urinal screen 130. Preferably, only the upper side 141 of the spreading layer 140 may contain the reagent 143 that can react with glucose in the urine sample.

In operation, the urinal screen 130 is place over the portion 121 of the drain 120 as illustrated clearly in FIG. 1.

In order to use the spreading layer 140 for measuring glucose levels, it is required to first place the urinal screen 130 in the urinal bowl 110 to extend over the portion 121 of the drain 120. In this process, the upper side 141 of the spreading layer 140 attached to the urinal screen 130 is supported to maintain horizontality without inclining to aside within the portion 121 of the drain 120.

In operation, a urine sample is applied to spreading the upper side 141 of the layer 140. As the urine sample penetrates the layer 140, it spreads out, so that sample is substantially uniformly distributed to the layer 140. The layer 140 contains a reagent 143 and membrane 144. Membrane 144 also contains a reagent 143 that reacts with glucose to cause a visible change in color. Membrane 144 contains a reagent 143 that also reacts with glucose to cause a color change, but the color formed in different from that formed in the layer 140. Glucose in the urine sample reacts with the reagents 143 in membranes 144 and the layer 140 as it passes toward the layer 140 to form colors. A variety of materials are suitable for the spreading layer 140; for example, paper, glass fibers, polymer fibers, plastics, woven and non-woven fabrics, and membranes. Preferred materials require minimum sample sizes, absorb the sample quickly, and distribute it uniformly to the membranes 144 and the layer 140.

In operation, the reagent 143 may react with glucose, metal, ketones, bilirubin, hemoglobin, nitric acid, nitrites, leucocytes, blood, and proteins in the urine sample.

Referring to FIG. 1, the image capturing unit 150 is configured to capture an image of the color change in the reagent 143, the image capturing unit 150 is attached to the urinal bowl 110, and the image capturing unit 150 is sized and shaped to be placed in the urinal bowl 110. Preferably, the image capturing unit 150 may be detachably attached to the urinal bowl 110.

The optical sensing unit 160 is configured to detect the color change in the reagent, the optical sensing unit 160 is attached to the urinal bowl 110, and the optical sensing unit 160 is sized and shaped to be placed in the urinal bowl 110. Preferably, the optical sensing unit 160 may be attached to the image capturing unit 150.

In operation, the image capturing unit 150 is configured to capture the image of the color change in the reagent 143 when the optical sensing unit 160 detects the color change in the reagent 143. The image capturing unit 150 is communicably connected to the optical sensing unit 160.

The urine analysis unit 170 is configured to analyze components of the urine sample. The urine analysis unit 170 is attached to the urinal bowl 110. The urine analysis unit 170 is configured to receive the image of the color change in the reagent 143 captured by the image capturing unit 150. The urine analysis unit 170 is configured to perform operations to analyze the image of the color change in the reagent 143. The urine analysis unit 170 is configured to generate a test result based on the operations about the components of the urine sample. Preferably, the urine analysis 170 unit may be detachably attached to the urinal bowl 110.

In operation, the test result may include the levels of glucose, metal, ketones, bilirubin, hemoglobin, nitric acid, nitrites, leucocytes, blood, or proteins in the urine sample that can indicate signal of disease.

Figure 2:
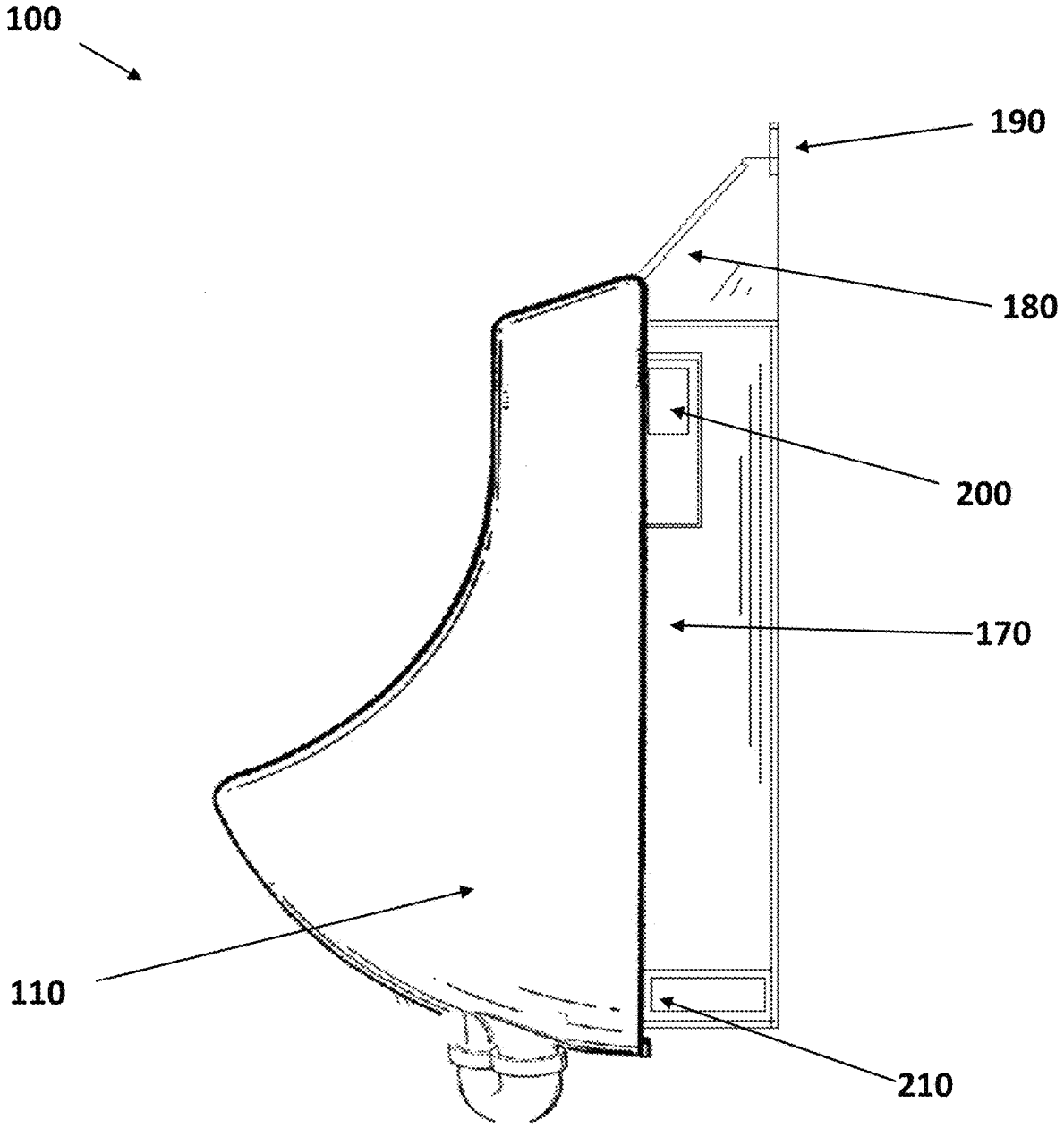
FIG. 2 illustrates a side view of a urinal system 100, in accordance with one embodiment of the present invention.

FIG. 2 illustrates a side view of a urinal system 100, in accordance with one embodiment of the present invention.

Figure 3:
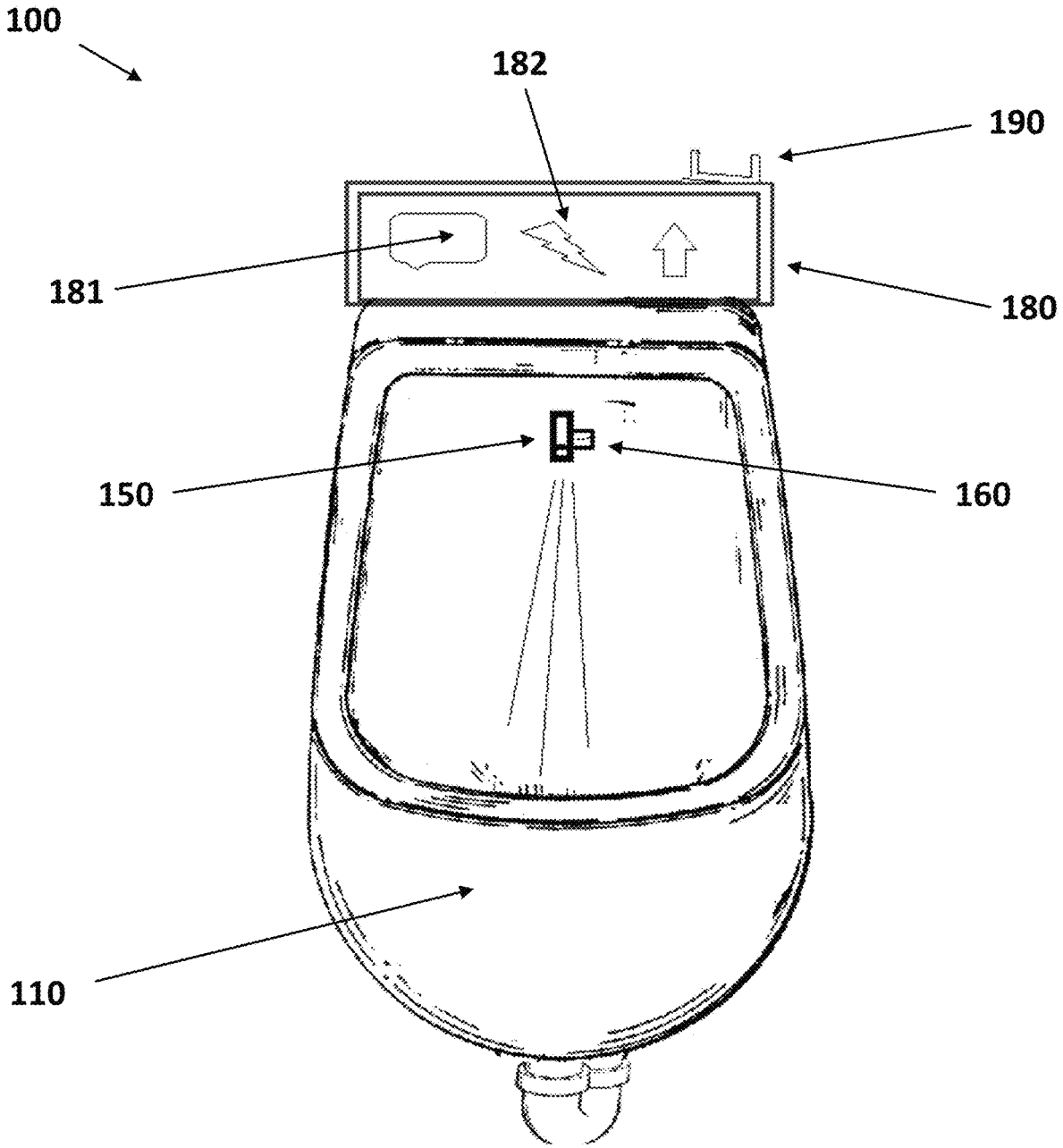
FIG. 3 illustrates a front view of a urinal system 100, in accordance with one embodiment of the present invention.

FIG. 3 illustrates a front view of a urinal system 100, in accordance with one embodiment of the present invention.

Referring to FIGS. 2 and 3, the display unit 180 is configured to display the test result for presentation to a user. The display unit 180 is attached to the urinal bowl 110. The display unit 180 is configured to receive the test result from the urine analysis unit 170. Preferably, the display unit 180 may be attached to the urine analysis unit 170.

The urine analysis 170 unit is communicably connected to the image capturing unit 150, the optical sensing unit 160, and the display unit 180.

Preferably, the urine analysis unit 170, the image capturing unit 150, the optical sensing unit 160, or the display unit 180 may be communicably connected to each other so that the urine analysis unit 170 can receive the image of the color change in the reagent 143 from the image capturing unit 150 and cause the display unit 180 to display the test result.

Referring to FIGS. 2 and 3, the display unit 180 is configured to enable the user to control one or more functions of the display unit 180 through a graphical interface 181 presented on the display unit 180.

A two-way wireless transceiver 190 attached to the display unit 180 is configured to connect the display unit 180 to a mobile telephone.

In operation, the display unit 180 is configured to cause the test result to be sent to the mobile telephone via the two-way wireless transceiver 190 if the user touches the graphical interface 181 presented on the display unit 180. The display unit 180 may be configured to display an advertisement 182. Additionally, a Bluetooth transceiver 200 may be attached to the display unit 180.

Preferably, the display unit 180, the two-way wireless transceiver 150, or the Bluetooth transceiver 200 may be communicably connected to each other so that the display unit 180 can cause the test result to be sent to the mobile telephone either via the two-way wireless transceiver 190 or the Bluetooth transceiver 200.

Preferably, the urinal system 100 may include a power supply 210 that supplies electric power to the image capturing unit 150, the optical sensing unit 160, the urine analysis unit 170, the display unit 180, the two-way wireless transceiver 190, and the Bluetooth transceiver 200.

Thus, the urinal system 100 disclosed herein enables people to considerably reduce the period and increase the accuracy for checking urine for sign of dieses because the present invention permits fast and accurate analysis of components of urine by using the spreading layer 140, the image capturing unit 150, the optical sensing unit 160, the urine analysis unit 170, and the display unit 180 attached to the urinal bowl 110 without the need for a urine dipstick or a meter.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A urinal system, comprising:

a urinal bowl;

a drain attached to the urinal bowl;

a urinal screen attached to the urinal bowl, the urinal screen being sized and shaped to be placed in the urinal bowl, wherein the urinal screen is configured to extend over a portion of the drain;

a spreading layer configured to accept a urine sample on a upper side and passing the sample to a lower side, opposite and each side containing a reagent that can react with glucose in the urine sample, as it passes through the spreading layer, to cause a color change in the reagent, wherein the spreading layer is attached to the urinal screen;

an image capturing unit configured to capture an image of the color change in the reagent, the image capturing unit being attached to the urinal bowl, the image capturing unit being sized and shaped to be placed in the urinal bowl;

an optical sensing unit configured to detect the color change in the reagent, the optical sensing unit being attached to the urinal bowl, the optical sensing unit being sized and shaped to be placed in the urinal bowl;

wherein the image capturing unit is configured to capture the image of the color change in the reagent when the optical sensing unit detects the color change in the reagent;

a urine analysis unit configured to analyze components of the urine sample, the urine analysis unit being attached to the urinal bowl, the urine analysis unit being configured to receive the image of the color change in the reagent captured by the image capturing unit, the urine analysis unit being configured to perform operations to analyze the image of the color change in the reagent, wherein the urine analysis unit is configured to generate a test result based on the operations about the components of the urine sample;

a display unit configured to display the test result for presentation to a user, the display unit being attached to the urinal bowl, the display unit being configured to receive the test result from the urine analysis unit; and wherein, the urine analysis unit is communicably connected to the image capturing unit, the optical sensing unit, and the display unit.

2. The urinal system according to claim 1, wherein the display unit is configured to enable the user to control one or more functions of the display unit through a graphical interface presented on the display unit.

3. The urinal system according to claim 1, wherein a two-way wireless transceiver attached to the display unit is configured to connect the display unit to a mobile telephone.

4. The urinal system according to claim 3, wherein the display unit is configured to cause the test result to be sent to the mobile telephone via the two-way wireless transceiver if the user touches the graphical interface presented on the display unit.

5. The urinal system according to claim 1, wherein the display unit is configured to display an advertisement.

6. The urinal system according to claim 1, wherein the reagent can react with glucose, metal, ketones, bilirubin, hemoglobin, nitric acid, nitrites, leucocytes, blood, and proteins in the urine sample.

7. The urinal system according to claim 1, wherein a Bluetooth transceiver is attached to the display unit.

8. A urinal system, comprising:

a urinal bowl;

a drain attached to the urinal bowl;

a urinal screen attached to the urinal bowl, the urinal screen being sized and shaped to be placed in the urinal bowl, wherein the urinal screen is configured to extend over a portion of the drain;

a spreading layer configured to accept a urine sample on a upper side and passing the sample to a lower side, opposite and the upper side containing a reagent that can react with glucose in the urine sample, as it passes through the spreading layer, to cause a color change in the reagent, wherein the spreading layer is attached to the urinal screen;

an image capturing unit configured to capture an image of the color change in the reagent, the image capturing unit being attached to the urinal bowl, the image capturing unit being sized and shaped to be placed in the urinal bowl;

an optical sensing unit configured to detect the color change in the reagent, the optical sensing unit being sized and shaped to be placed in the urinal bowl;

wherein the image capturing unit is configured to capture the image of the color change in the reagent when the optical sensing unit detects the color change in the reagent;

a urine analysis unit configured to analyze components of the urine sample, the urine analysis unit being attached to the urinal bowl, the urine analysis unit being configured to receive the image of the color change in the reagent captured by the image capturing unit, the urine analysis unit being configured to perform operations to analyze the image of the color change in the reagent, wherein the urine analysis unit is configured to generate a test result based on the operations about the components of the urine sample;

a display unit configured to display the test result for presentation to a user, the display unit being attached to the urinal bowl, the display unit being configured to receive the test result from the urine analysis unit; and wherein, the urine analysis unit is communicably connected to the image capturing unit and the display unit.

9. The urinal system according to claim 8, wherein the display unit is configured to enable the user to control one or more functions of the display unit through a graphical interface presented on the display unit.

10. The urinal system according to claim 8, wherein a two-way wireless transceiver attached to the display unit is configured to connect the display unit to a mobile telephone.

11. The urinal system according to claim 10, wherein the display unit is configured to cause the test result to be sent to the mobile telephone via the two-way wireless transceiver if the user touches the graphical interface presented on the display unit.

12. The urinal system according to claim 8, wherein the display unit is configured to display an advertisement.

13. The urinal system according to claim 8, wherein the reagent can react with glucose, metal, ketones, bilirubin, hemoglobin, nitric acid, nitrites, leucocytes, blood, and proteins in the urine sample.

14. The urinal system according to claim 8, wherein a Bluetooth transceiver is attached to the display unit.

15. A urinal system, comprising:

a urinal bowl;

a drain attached to the urinal bowl;

a urinal screen attached to the urinal bowl, the urinal screen being sized and shaped to be placed in the urinal bowl, wherein the urinal screen is configured to extend over a portion of the drain;

a spreading layer configured to accept a urine sample on a upper side and passing the sample to a lower side, opposite and the upper side containing a reagent that can react with glucose in the urine sample, as it passes through the spreading layer, to cause a color change in the reagent, wherein the spreading layer is attached to the urinal screen;

an image capturing unit configured to capture an image of the color change in the reagent, the image capturing unit being sized and shaped to be placed in the urinal bowl;

an optical sensing unit configured to detect the color change in the reagent, the optical sensing unit being sized and shaped to be placed in the urinal bowl;

wherein the image capturing unit is configured to capture the image of the color change in the reagent when the optical sensing unit detects the color change in the reagent;

a urine analysis unit configured to analyze components of the urine sample, the urine analysis unit being attached to the urinal bowl, the urine analysis unit being configured to receive the image of the color change in the reagent captured by the image capturing unit, the urine analysis unit being configured to perform operations to analyze the image of the color change in the reagent, wherein the urine analysis unit is configured to generate a test result based on the operations about the components of the urine sample;

a display unit configured to display the test result for presentation to a user, the display unit being configured to receive the test result from the urine analysis unit; and wherein, the urine analysis unit is communicably connected to the image capturing unit and the display unit.

16. The urinal system according to claim 15, wherein the display unit is configured to enable the user to control one or more functions of the display unit through a graphical interface presented on the display unit.

17. The urinal system according to claim 15, wherein a two-way wireless transceiver attached to the display unit is configured to connect the display unit to a mobile telephone.

18. The urinal system according to claim 17, wherein the display unit is configured to cause the test result to be sent to the mobile telephone via the two-way wireless transceiver if the user touches the graphical interface presented on the display unit.

19. The urinal system according to claim 15, wherein the display unit is configured to display an advertisement.

20. The urinal system according to claim 15, wherein the reagent can react with glucose, metal, ketones, bilirubin, hemoglobin, nitric acid, nitrites, leucocytes, blood, and proteins in the urine sample.

* * * * *